US007163469B2

(12) United States Patent
Bonneau

(10) Patent No.: US 7,163,469 B2
(45) Date of Patent: Jan. 16, 2007

(54) REAR, PERIMETER, AND FACE WEIGHTED PUTTER SUPPORT

(76) Inventor: Michael D. Bonneau, 5831 Algonquin Way, San Jose, CA (US) 95138

( * ) Notice: Subject to any disclaimer, the term of this patent is extended or adjusted under 35 U.S.C. 154(b) by 0 days.

(21) Appl. No.: 11/217,650

(22) Filed: Sep. 1, 2005

(65) Prior Publication Data

US 2006/0019767 A1 Jan. 26, 2006

Related U.S. Application Data

(63) Continuation-in-part of application No. 10/826,184, filed on Apr. 15, 2004.

(51) Int. Cl.
*A63B 43/04* (2006.01)
*A63B 53/06* (2006.01)

(52) U.S. Cl. ..... 473/334; 473/340; 473/341; 473/349

(58) Field of Classification Search ..... 473/334–339, 473/340–341, 288, 349, 736–746, 324–329, 473/350, 290–291, 244–256, 345
See application file for complete search history.

(56) References Cited

U.S. PATENT DOCUMENTS

| | | | | | |
|---|---|---|---|---|---|
| 1,666,174 | A | * | 4/1928 | Holland | 473/251 |
| RE19,178 | E | * | 5/1934 | Spiker | 473/251 |
| 3,143,349 | A | * | 8/1964 | MacIntyre | 473/338 |
| 4,121,832 | A | | 10/1978 | Ebbing | 273/171 |
| 4,194,739 | A | | 3/1980 | Thompson | 273/79 |
| 5,211,401 | A | | 5/1993 | Hainey | 273/167 F |
| 5,489,097 | A | | 2/1996 | Simmons | 273/170 |
| 5,494,288 | A | | 2/1996 | Jimenez et al. | 273/164.1 |
| 5,577,726 | A | | 11/1996 | Fenton | 473/305 |
| 5,676,606 | A | | 10/1997 | Schaeffer et al. | 473/340 |
| 5,733,203 | A | | 3/1998 | Middleton | 473/248 |
| 5,769,738 | A | * | 6/1998 | Kershaw et al. | 473/340 |
| 5,782,705 | A | | 7/1998 | Solari | 473/300 |
| 5,782,706 | A | | 7/1998 | DePriest | 473/341 |
| 5,797,176 | A | | 8/1998 | Rose et al. | 29/527.5 |
| 5,803,825 | A | * | 9/1998 | Hamilton | 473/252 |
| 5,816,930 | A | | 10/1998 | Brown | 473/254 |
| 5,827,130 | A | | 10/1998 | Jimenez et al. | 473/313 |
| 5,839,974 | A | | 11/1998 | McAllister | 473/337 |
| 5,842,935 | A | | 12/1998 | Nelson | 473/342 |
| 5,871,407 | A | | 2/1999 | Tseng | 473/328 |
| 5,951,412 | A | | 9/1999 | Rose et al. | 473/340 |
| 5,971,867 | A | | 10/1999 | Galy | 473/345 |
| 6,017,280 | A | | 1/2000 | Hubert | 473/324 |

(Continued)

*Primary Examiner*—Sebastiano Passaniti
(74) *Attorney, Agent, or Firm*—Schneck & Schneck

(57) ABSTRACT

A golf putter head has a main body frame that is rear, perimeter and face weighted. A first weighting member weights the main body frame in the front and a second weighting member weights the rear and perimeter of the main body frame providing a dynamically balanced putter. The main body frame has a front region, a top surface with an underside in an upper portion of the main body frame, and a sole with a bridge, in one example, extending out from the sole to the second weighting member. The first weighting member is attached to the front of the main body frame, and the second weighting member is attached to the underside of the main body frame. The main body frame supports various combinations of first and second weighting member weights and main body weights to achieve a dynamically balanced putter.

22 Claims, 8 Drawing Sheets

U.S. PATENT DOCUMENTS

| | | | | |
|---|---|---|---|---|
| 6,080,068 | A | 6/2000 | Takeda | 473/305 |
| 6,123,627 | A | 9/2000 | Antonious | 473/327 |
| 6,149,534 | A | 11/2000 | Peters et al. | 473/345 |
| 6,213,890 | B1 | 4/2001 | Prince | 473/292 |
| 6,267,689 | B1 | 7/2001 | Ambrose | 473/251 |
| 6,270,423 | B1 | 8/2001 | Webb | 473/226 |
| 6,315,678 | B1 | 11/2001 | Teramoto | 473/291 |
| 6,319,146 | B1 | 11/2001 | Mills | 473/244 |
| 6,336,869 | B1 | 1/2002 | Hettinger et al. | 473/324 |
| 6,354,959 | B1 | 3/2002 | Nicolette et al. | 473/305 |
| 6,383,089 | B1 | 5/2002 | Bonneau | 473/313 |
| 6,386,990 | B1 | 5/2002 | Reyes et al. | 473/344 |
| 6,409,612 | B1 | 6/2002 | Evans et al. | 473/324 |
| 6,416,421 | B1 | 7/2002 | Sery | 473/305 |
| 6,450,897 | B1 | 9/2002 | Stites et al. | 473/334 |
| 6,471,600 | B1 * | 10/2002 | Tang et al. | 473/242 |
| 6,485,375 | B1 | 11/2002 | McKinley | 473/245 |
| 6,607,452 | B1 | 8/2003 | Helmstetter et al. | 473/345 |
| 6,783,466 | B1 | 8/2004 | Seki et al. | 473/345 |
| 6,796,911 | B1 * | 9/2004 | Grace | 473/251 |

* cited by examiner

REAR, PERIMETER, AND FACE WEIGHTED PUTTER SUPPORT

CROSS-REFERENCE TO RELATED APPLICATIONS

This application is a continuation-in-part of U.S. application Ser. No. 10/826,184 entitled "Rear, Perimeter, and Face Weighted Putter Support", filed on Apr. 15, 2004 which is hereby incorporated by reference.

FIELD OF THE INVENTION

The invention relates to putters in general, and, in particular, to weighted putter heads.

BACKGROUND OF THE INVENTION

Various types of golf clubs have been developed to assist golfers in improving their golfing skills. In particular, golf putters have been designed in the past with embedded weights in the club head to assist a golfer in improving his putting skills. Balancing the putter head is important so that one can consistently address and stroke the ball properly to make straight putts. A putter that is balanced will usually give the "best feel" and yield the greatest accuracy.

For instance, U.S. Pat. No. 6,485,375 to McKinley discloses a high center of gravity modular putter having interchangeable weight inserts along the side of the putter, rails that run longitudinally from the rear to the front of the putter head, and an insert face block having a softer or harder compound and a cavity.

U.S. Pat. No. 5,676,606 to Schaeffer et al. discloses a putter head with an arcuate weight heavier than the material of the rest of the club. The weighting member is positioned to provide a low center of gravity.

U.S. Pat. No. 5,839,974 to McAllister discloses weighted inserts for a putter face plate that will bias the putter into a "closed face" or "open face" alignment.

U.S. Pat. No. 6,270,423 to Webb discloses a putter having a front face formed with a depression in order to insertably receive one of the selected cartridges within which a pad, selected from a group of pads having different densities is selected.

Although there are a wide variety of putters available to golfers, golfers still seek improved designs that will assist them in yielding the greatest accuracy during putting.

Therefore, it is an object of the present invention to provide a new and improved putter head.

A further object of the present invention is to provide a putter head which has a high center of gravity.

It is an additional object of the present invention to provide a putter head that is dynamically balanced.

It is another object of the present invention to provide a new and improved putter.

SUMMARY OF THE INVENTION

The above and other objects have been achieved with a putter head including a main body frame that is rear, perimeter and face weighted. The main body frame forms a support structure for added weighted portions. The main body frame has a front portion, a top surface with an underside in an upper portion of the main body frame. A first weighting member is attached to the front of the main body frame, and a second weighting is member is attached to the underside. The first weighting member provides additional weight in a front portion of the putter head and the second weighting member provides additional rear and side weight in an upper portion of the putter head, resulting in a dynamically balanced putter.

To achieve a dynamically balanced putter, various combinations of first and second weighting member weights and main body weights are used. For example, it is desired that either the first weighting member and the second weighting member or the first weighting member and the main body have the same weight to achieve a dynamically balanced putter. In one example, any two of the group consisting of a first weighting member weight, a second weighting member weight, and a main body weight are the same weight. In one example, the first weighting member and second weighting member each weigh more than the main body. In another example, the first and second weighting members each weigh less than the main body. In an additional example, the first weighting member and the main body weigh more than the second weighting member. In another example, the first weighting member and the main body each weigh less than the second weighting member.

To achieve the various weight combinations the first weighting member, the second weighting member and the main body frame are comprised of various materials. For example, the main body is comprised of a first material having a first density and the first and second weighting members are comprised of a different material having a different density, with respect to the first material density. In one example, the different material has a density greater than the density of the first material.

Various materials may be utilized in the present invention. For example, the main body frame is comprised of aluminum while the first and second weighting members are comprised of a material selected from the group consisting of brass, tungsten, stainless steel, and iron.

Additionally, in one embodiment, the main body frame further includes a sole opposed to the top surface, a perimeter defining side and rear surfaces of the main body, and a front surface disposed between the side surfaces. The top surface and the underside extend outwardly to the perimeter surfaces.

In one embodiment of the present invention, the main body frame includes a bridge element extending out from the sole.

Any type of putter, such as for example, a mallet style putter or a blade putter may include the putter head of the present invention. The putter head is modular in design. Additionally, any putter may be altered to include the main body frame of the present invention. Specifically, when altering a putter head, an upper portion of the putter head is milled out to receive a weighting member and a front portion of the putter head is milled out to receive another weighting member.

The putter head of the present invention has a high center of gravity. This is due, at least in part, to the placement of the weighted member in an upper portion of the putter head. Additionally, the main body of the putter may itself have a high center of gravity. Where the main body frame of a prior art putter lacks a high center of gravity, the main body is milled out and one or more of the weighting members attached to the body provide the main body and the putter head with a high center of gravity.

The putter head of the present invention is advantageous in at least that it recognizes the importance of a relationship between a first weighting member, a second weighting member, and the main body and uses that relationship to achieve a dynamically balanced putter. Further, it provides a main body frame that forms a support structure for the weighted portions. A dynamically balanced putter results in less torquing of the club. Thus, the putter of the present invention "feels good" to a golfer. This allows a golfer to consistently address and stroke the ball properly to make straight putts, yielding a good accuracy. Upon striking a ball with a putter incorporating the putter head of the present invention, the ball achieves an immediate forward roll which is desirable when putting.

DETAILED DESCRIPTION OF THE INVENTION

Figure 1:
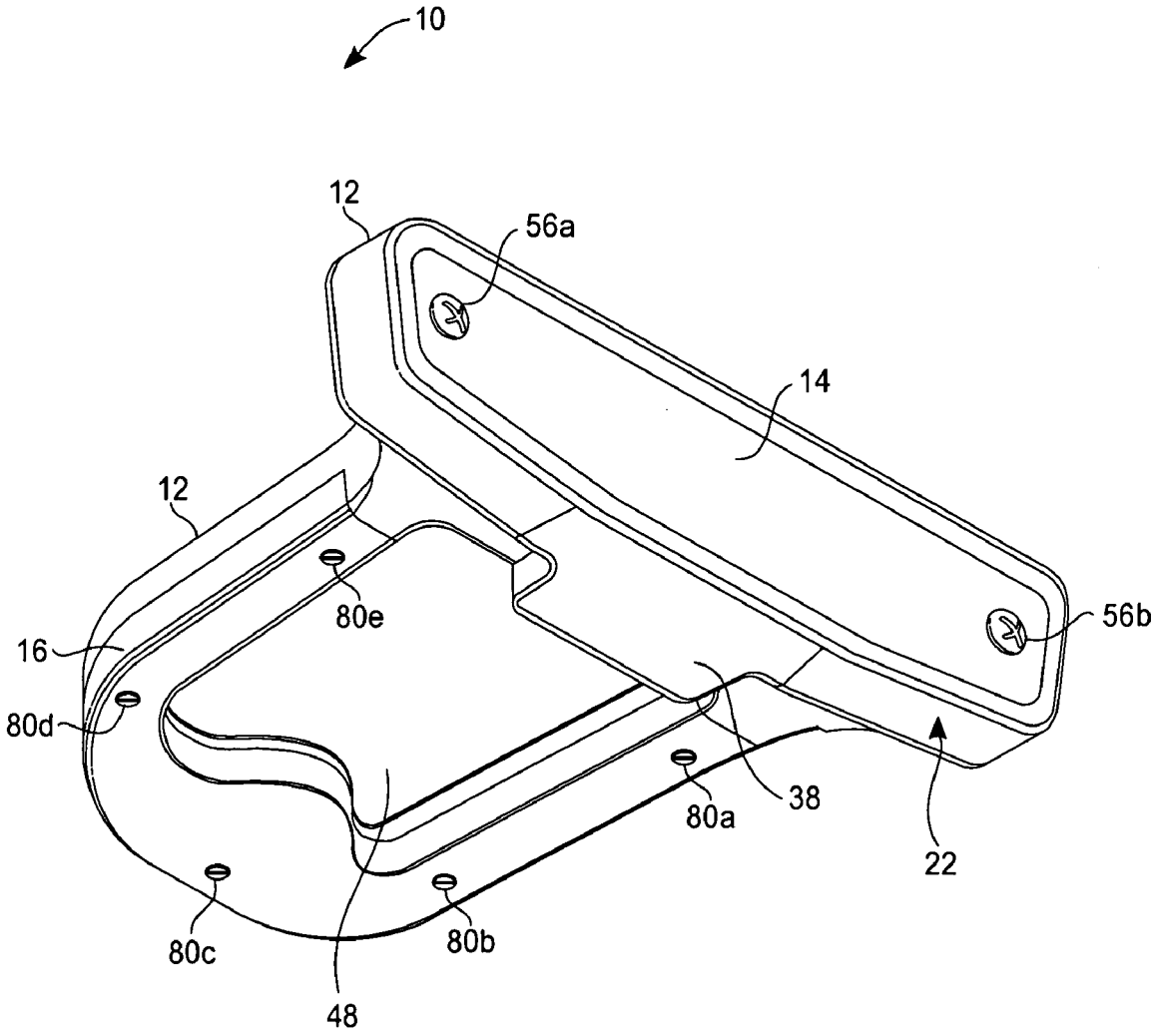
FIG. 1 is a perspective view of one embodiment of the putter head of the present invention.
Figure 2:
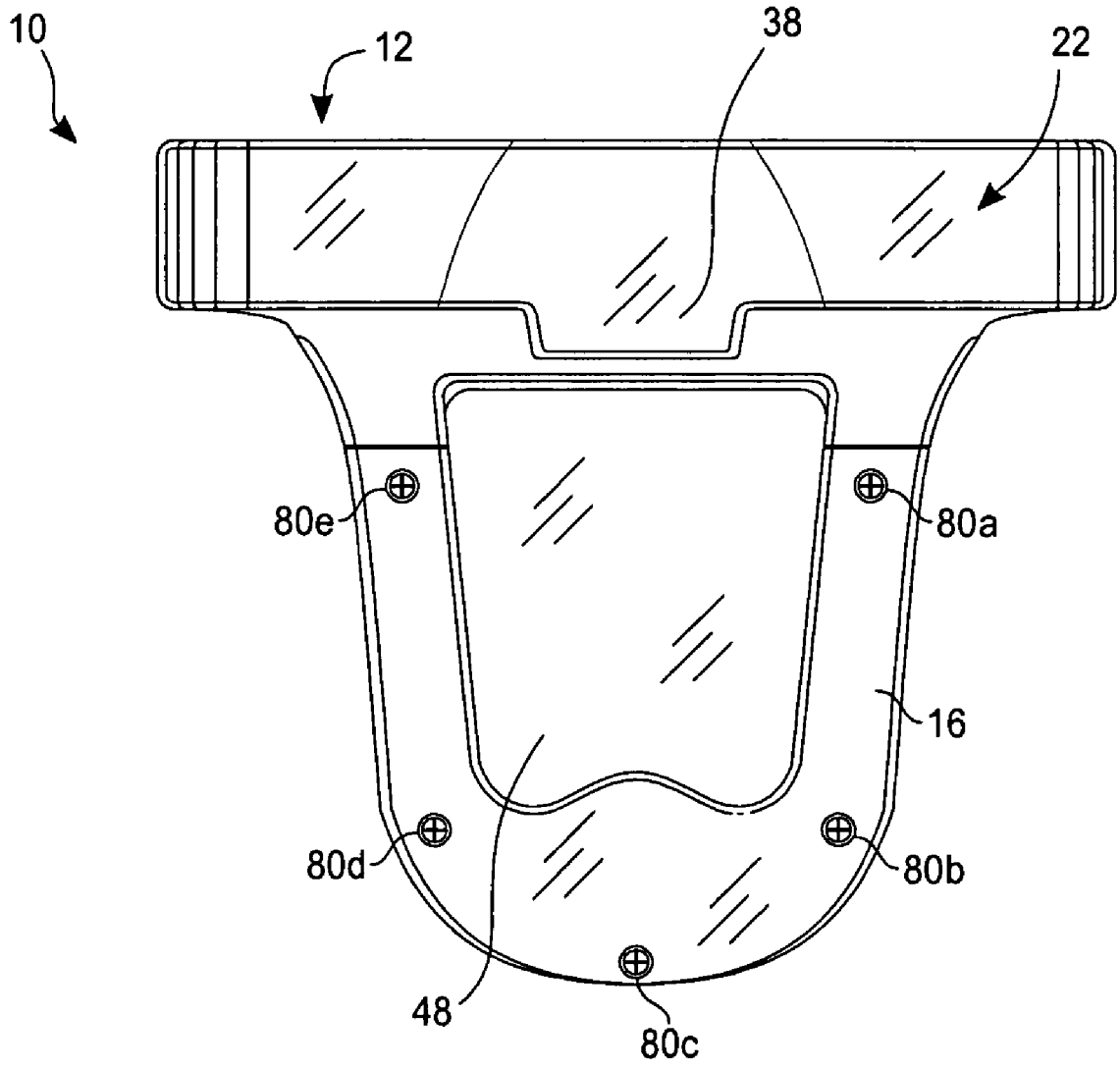
FIG. 2 is a bottom view of the putter head of FIG. 1.

With reference to FIGS. 1 and 2, a putter head 10 of the present invention is seen. A mallet style putter head is pictured, however, other putter heads, such as a blade style putter head, may be used to achieve the putter head of the present invention. The putter head features a main body frame 12, first weighting member 14, second weighting member 16, the main body frame 12, the first weighting member 14, and the second weighting member 16 having various combinations of weights. The main body frame 12 forms a support structure for added weight portions. The putter head 10 is modular in design.

Various combinations of first and second weighting member weights and main body frame weights are used, as will be described below, to achieve a dynamically balanced putter. To achieve the various combinations of weights, the first weighting member 14, the second weighting member 16, and the main body frame 12 are comprised of materials having particular densities. In one example, each weighting member is comprised of a material having a density greater than the density of the main body frame. The first weighting member 14 and the second weighting member 16 may be comprised of the same material having the same density or of different materials having densities that differ from each other. The weighting members are comprised of, for example, one of brass, tungsten, stainless steel, and iron. The main body frame 12 is comprised of, for example, aluminum.

Figure 3:
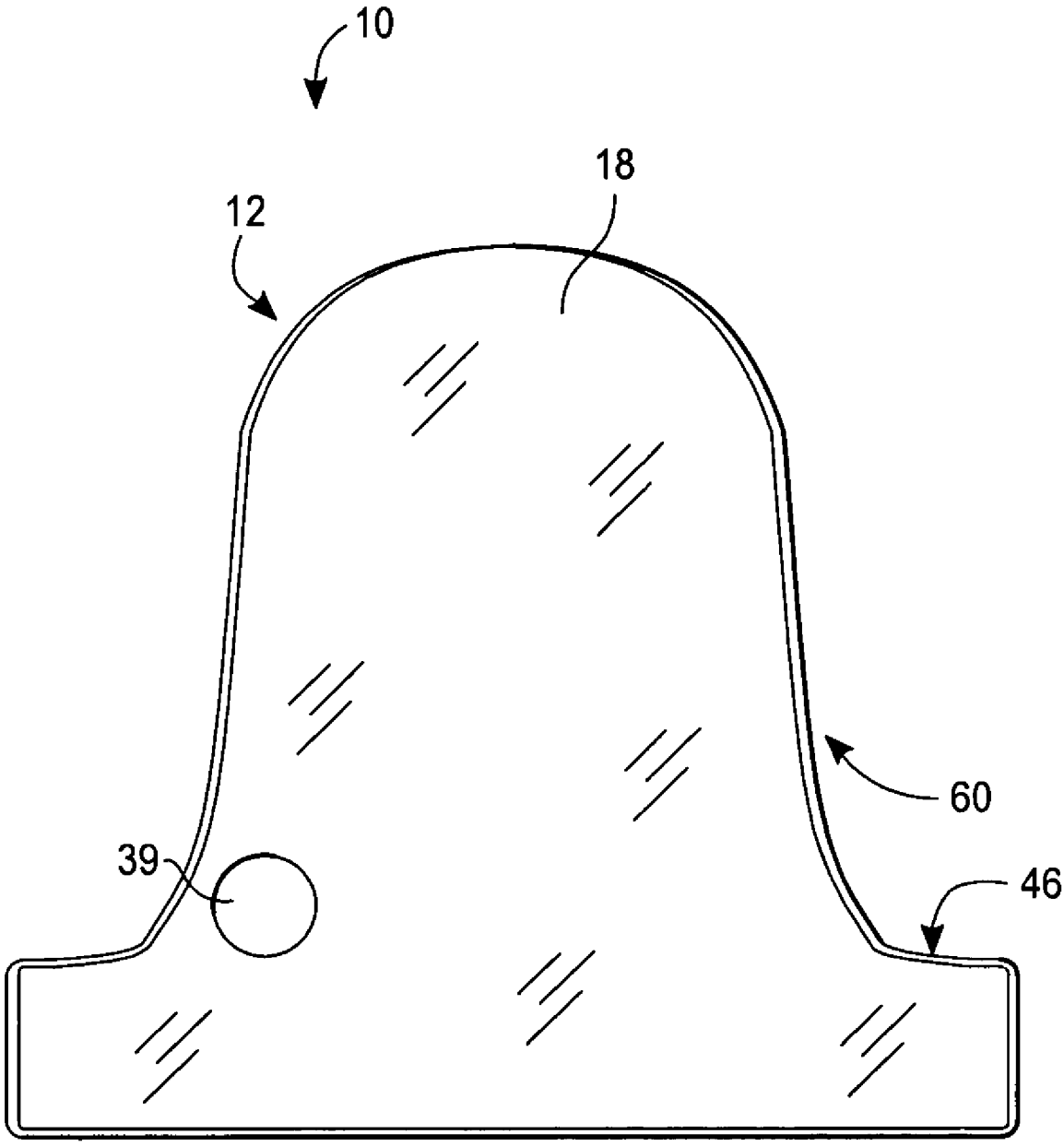
FIG. 3 is a top view of the putter head of FIG. 2.
Figure 7:
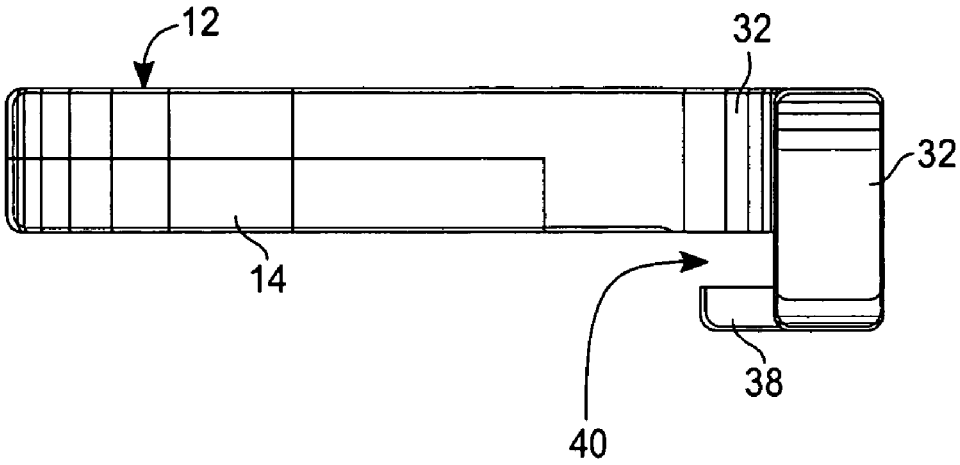
FIG. 7 is a right side view of the putter head of FIG. 1.
Figure 8:
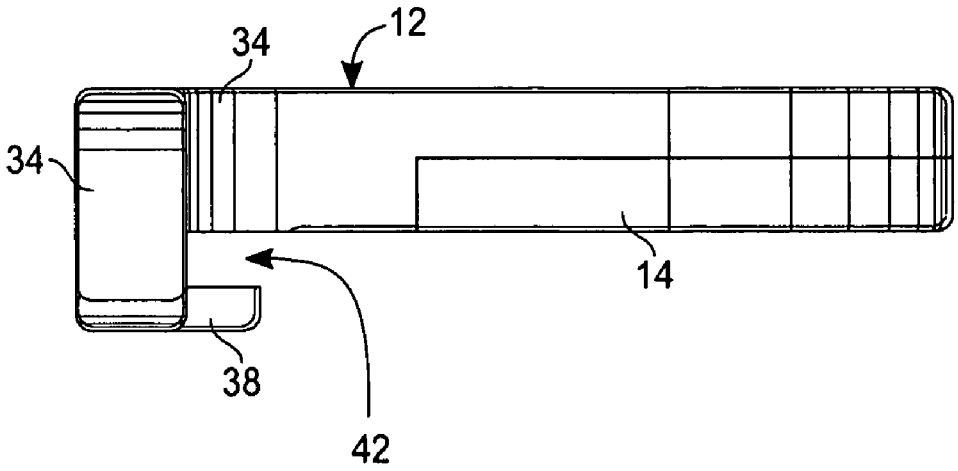
FIG. 8 is a left side view of the putter head of FIG. 1.

The main body frame includes a top surface 18 (FIG. 3), and underside of the top surface 20 (FIG. 4) disposed in an upper portion of the main body frame 12, a sole 22 opposed to the top surface, and a perimeter 24 defining side surfaces 26 and 28 and rear surface 30 (FIG. 6) of the main body frame 12, the side surfaces 26 and 28 including heel and toe ends 32 and 34 (FIGS. 7 and 8), respectively, and a front surface 36 (FIG. 4) disposed between the side surfaces 26 and 28. A hosel 39 (FIG. 3) is seen on the top surface. A putter shaft (not shown) is mounted within the hosel. In one example, the sole 22 (FIG. 4) includes a tongue 38 extending outwardly from the sole. The tongue, for example, has a length of 1 inch. The sole 22, for example, has a width substantially less than the width of the top surface 18. In one example, the sole 22 has a width that is approximately ⅙ of the width of the top surface. In one example, the heel end 34 and the toe end 36 are stepped, as seen in FIGS. 7 and 8. The stepped heel and toe ends form recesses 40 and 42.

Figure 4:
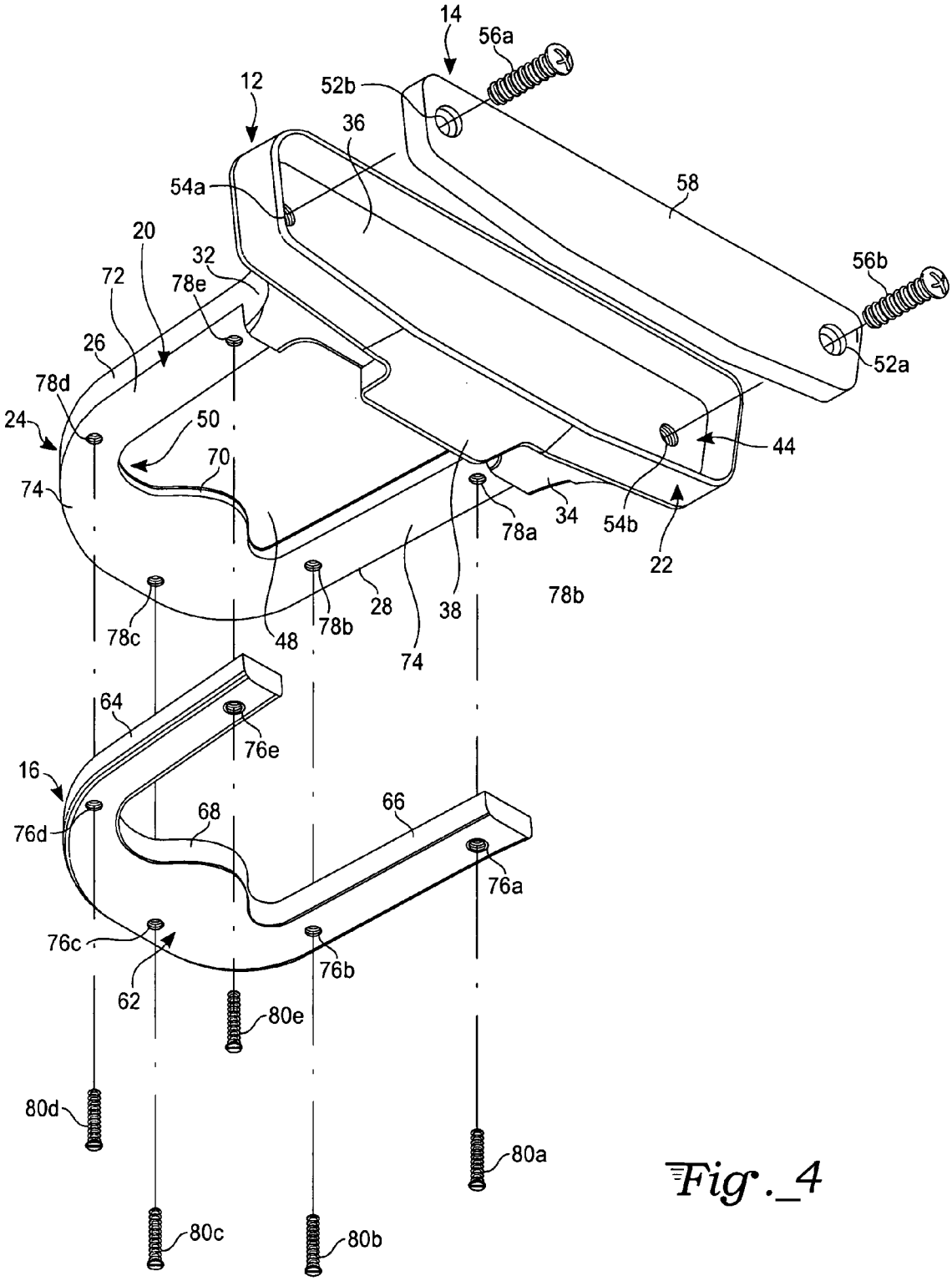
FIG. 4 is an exploded view of the putter head of FIG. 1.
Figure 5:
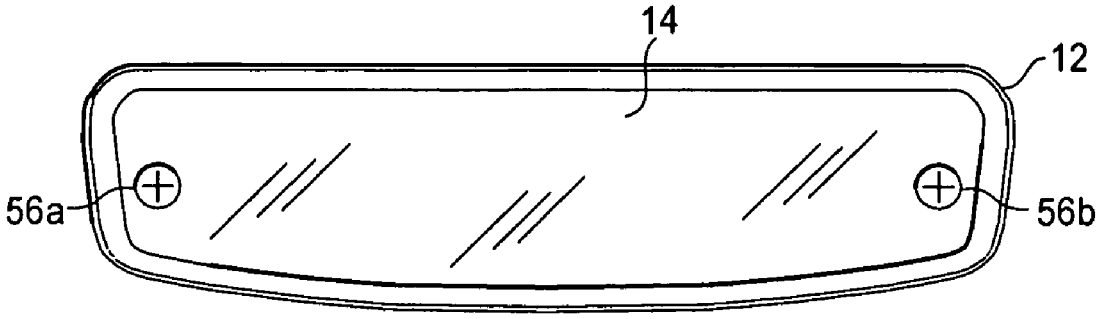
FIG. 5 is a front view of the putter head of FIG. 1.

The pictured main body frame 12 has a high center of gravity. In one example, the upper portion, within which the underside is disposed, is an upper half of the main body frame 12. The front surface 36 is, for example, disposed within a front recess 44 (FIG. 4). For instance, the upper portion is ½ the height of a front portion 46 (FIG. 3) of the main body frame 12 including the recess 44. The top surface 18 (FIG. 3) and the underside 20 (FIG. 4) extend outwardly to the perimeter surfaces 26 and 28 and rear surface 30. In one example, the underside 20 includes an underside surface 48 that is raised relative to underside surface 74, forming a recess 50.

Figure 6:
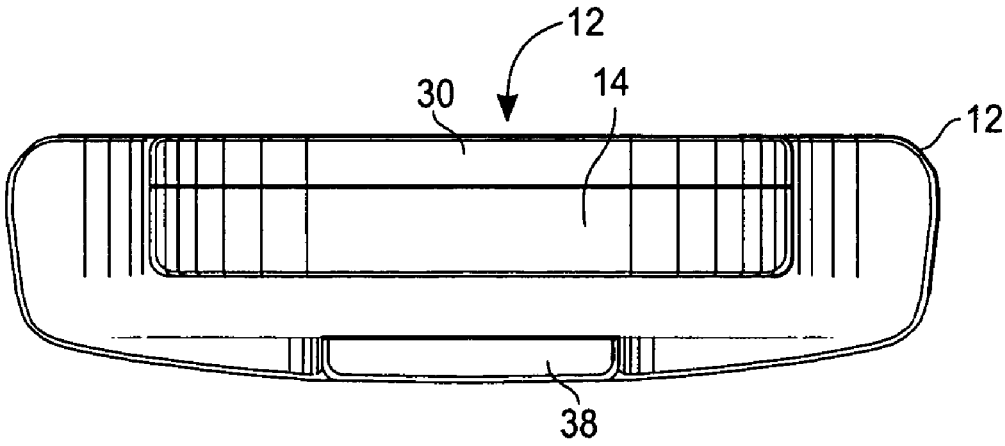
FIG. 6 is a rear view of the putter head of FIG. 1.

With reference to FIGS. 4 and 6, the first weighting member 14 is attached to the front surface 36. In the pictured example, the first weighting 14 includes a pair of openings 52*a* and 52*b*, and the front surface 36 includes a pair of threaded openings 54*a* and 54*b*. The first weighting member 14 is received within the recess 44 such that the openings 52 and 54 are in alignment. The first weighting member 14 is attached to the front surface 36 by, for example, a pair of screws 56*a* and 56*b* inserted within the openings 52*a* and 52*b*, respectively, and threaded within the openings 54*a* and 54*b*, respectively. The first weighting member 14 has a shape that is substantially the same as the shape of the recess. The first weighting member has a front surface 58, against which a golf ball (not shown) is struck. The front surface 58 may be substantially flat or may include a loft angle. The first weighting member 14 is customizable and may be interchangeable with other weighting members having, for example, various loft angles and/or more or less weight towards either end of the first weighting member.

Still referring to FIG. 4, the second weighting member 16 is attached to the underside 20 of a rear portion 60 (FIG. 3) of the main body frame 12 disposed behind the front portion 46 of the putter head 10. The second weighting member 16 includes a rear portion 62 and opposed side portions 64 and 66 that extend outwardly to the perimeter surfaces 24. The second weighting member 16 is of a shape equal to a shape of the underside 20 or a portion of the underside 20. In the pictured example, the second weighting member 16 is horseshoe shaped and includes a middle portion having a tortuous inner surface 68 that has a width greater than a width of the side portions 64 and 66. Conversely, in the pictured example, the underside 20 is horseshoe shaped and includes a middle portion having a tortuous inner surface 70 that has a width greater than side portions 72 and 74 of the horseshoe shaped underside. In the pictured example, the second weighting member 16 includes a plurality of openings 76*a–e* that align with a plurality of threaded openings 78*a–e* of the underside. The second weighting member 16 is attached to the underside 20 of the main body frame by, for example, a plurality of screws 80*a–e* inserted within the openings 76*a–e*, respectively, and threaded within the openings 78*a–e*, respectively. The second weighting member 16 is flush with respect to the side surfaces 26 and 28 and rear surface 30 of the main body 12.

Figure 9:
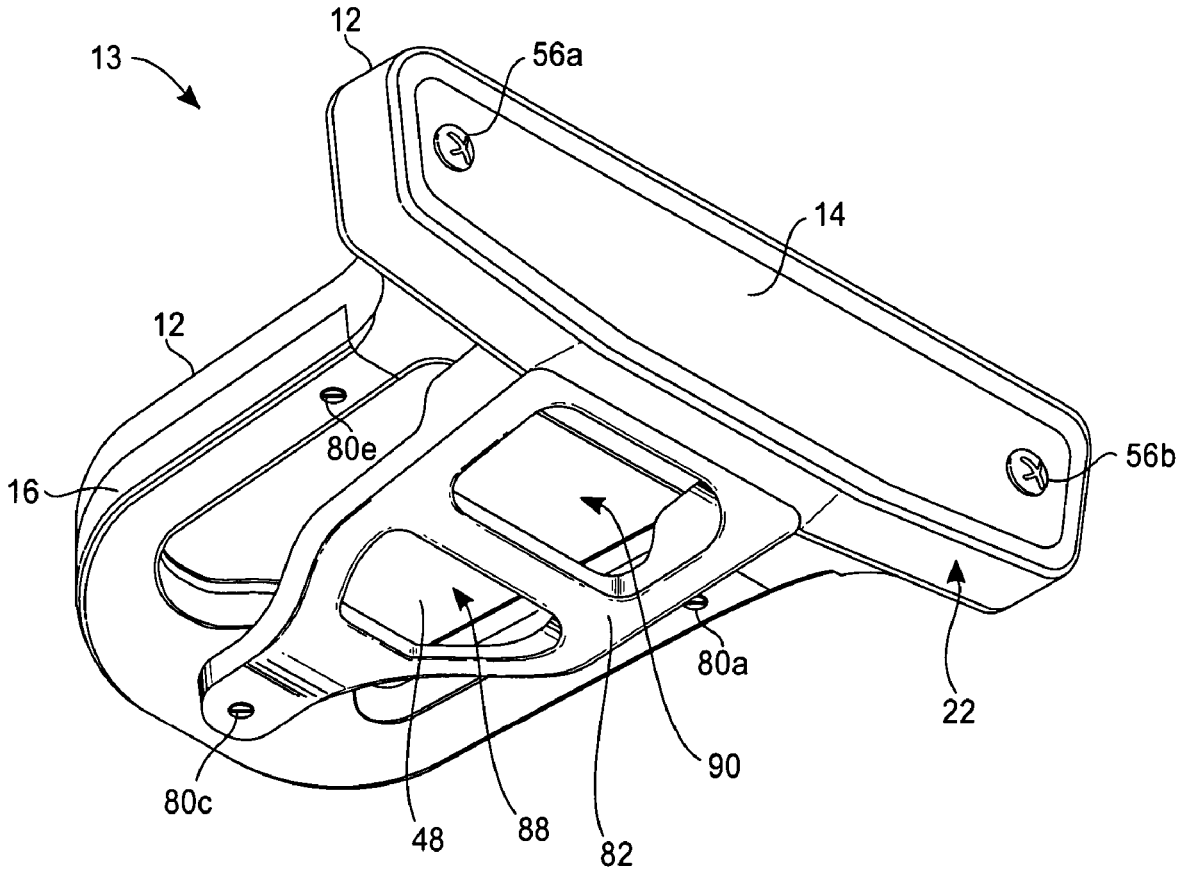
FIG. 9 is a perspective view of another embodiment of a putter head of the present invention.
Figure 10:
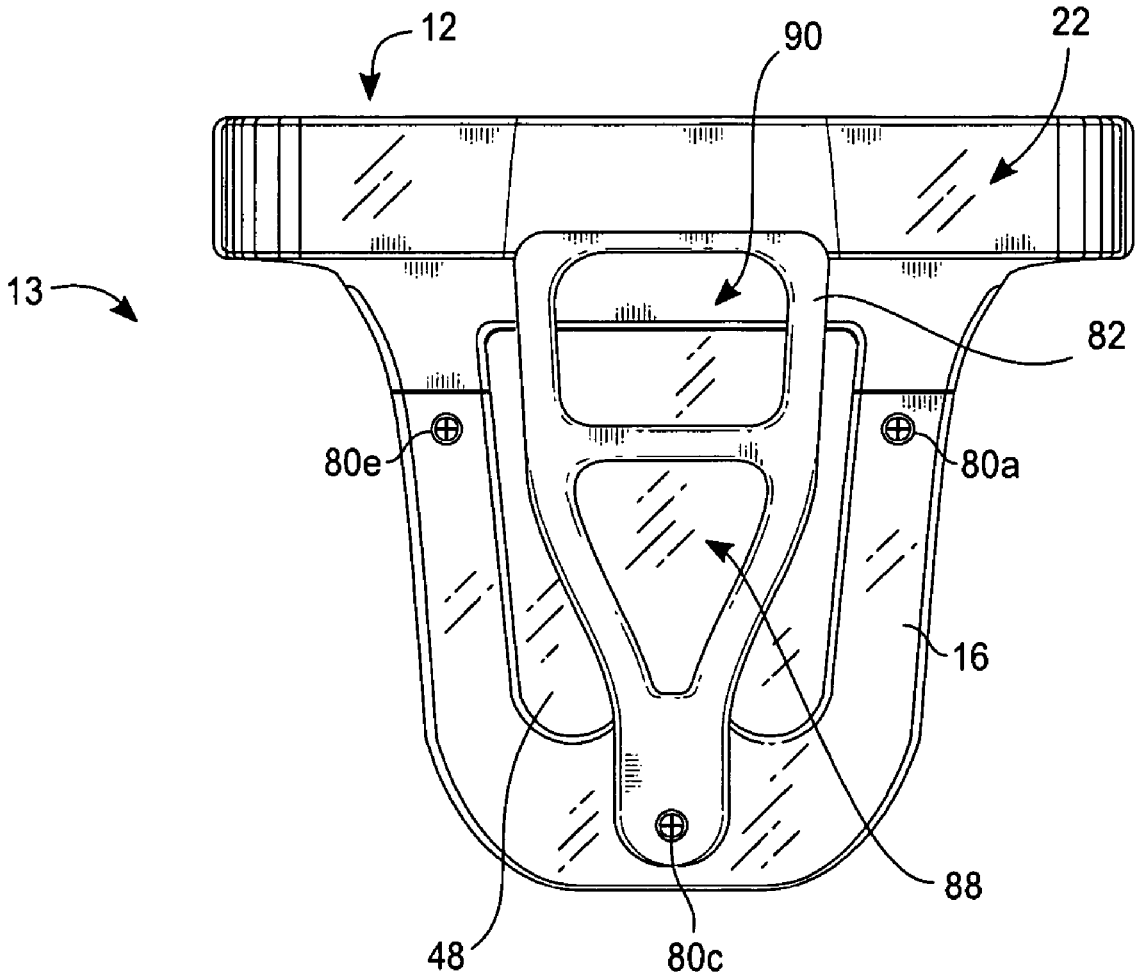
FIG. 10 is a bottom view of the putter of FIG. 9.

In one embodiment of the present invention, main body frame 12 of putter head 13 includes a bridge 82 (instead of tongue 38 seen in FIG. 1) extending from sole 22 to the second weighting member 16 as seen in FIGS. 9 and 10. In one example, the bridge is comprised of aluminum. The bridge 82 may be integral with or a separate piece from the sole and/or main body frame 12. The bridge 82 may include one or more apertures, for example, apertures 88 and 90. In one example, the bridge is angled upwardly from weighting member 16 toward side 22. In one example, the bridge is approximately 2¾ inches long and about 1½ inches wide at its widest dimension and about ½ inch wide at its least wide dimension. In one example, screw 80*c* is threaded within an opening (not shown) of the bridge 82 and within corresponding openings 76*c* and 78*c* of the second weighting member 16 and main body frame 12, respectively, to connect the bridge to the second weighting member at one end. At an opposing end of the bridge, for example, the bridge is attached or otherwise connected to the sole and/or other portions of the main body frame 12.

In one example, screws 80*a* and 80*e* are used to connect the second weighting member 16 to the main body frame, as with putter head 10, but screws 80*d* and 80*b* are not used. In another example, screws 80*d* and 80*b* are used with putter head 13. The features of putter head 13 other than the bridge are, for example, the same as putter head 10. A putter head including bridge 82 of the present invention is advantageous for at least the reasons that is increases striking stability and decrease the influence of uneven grass.

In one embodiment of the present invention, the main body frame 12 of the putter head 10 or the putter head 13 (including or excluding the bridge) of the present invention is formed by milling out portions of an already existing putter head and attaching the first and second weighting members to the frame, as described above. A front portion, including a front surface, such as surface 36 is milled out of the existing putter head. The first weighting member 14 is secured to the front surface of the milled out front portion. A portion beneath a top surface of the existing putter head, including an underside such as underside 20, is milled out in an upper portion of the main body frame. The second weighting member 16 is secured to an underside of the milled out upper portion beneath the top surface.

Various combinations of weights are used in the present invention to achieve a dynamically balanced putter head 10 or 13. It is desirable that any two of the group consisting of the main body frame 12, first weighting member 14, and second weighting member 16 have the same weight. In one example of the present invention, the first weighting member 14 and the second weighting member 16 have the same weight. For example, the main body frame 12 comprises a weight that is 20% of a weight of the putter head and the first weighting member 14 and the second weighting member 16 each comprise a weight that is 40% of the putter head. In the above example, the main body frame 12 has a weight that is less than the weight of each of the first weighting member 14 and the second weighting member 16. However, the main body frame 12 may have a weight that is greater than the weight of each of the first weighting member 14 and the second weighting member 16.

In an additional example of the present invention, the first weighting member 14 and the main body frame 12 comprise the same weight. For example, the first weighting member 14 and the main body frame 12 each comprise a weight that is 30% of the weight of the putter head 10 or 13 and the second weighting member 16 comprises a weight that is 40% of the weight of the putter head. In the above example, the second weighting member 16 has a weight that is greater than the weight of each of the first weighting member 14 and the main body frame 12. In another example, the second weighting member 16 may have a weight that is less than the weight of each of the first weighting member 14 and the main body frame 12.

In another example, the main body frame 12 has a weight greater than each of the first weighting member 14 and the second weighting member 16. For example, where the golf putter head 10 or 13 has a total weight of 340 grams, the first weighting member 14 has a weight of 110 grams, the second weighting member 16 has a weight of 110 grams, and the main body frame 12 has a weight of 120 grams. In this example of the present invention, the first weighting member 14, the second weighting member 16 and the main body frame 12 are approximately equal in weight, i.e. they are each approximately ⅓ of the weight of the putter head.

What is claimed is:

1. A golf putter head comprising:

a main body frame having a top surface, an underside of the top surface, the underside disposed in an upper portion of the main body frame, a perimeter defining side and rear surfaces of the main body, a front surface disposed between said side surfaces, and a sole opposed to the top surface;

a first weighting member attached to said front surface of said main body frame; and a second weighting member attached to said underside, said second weighting member including a rear portion and opposed side portions extending outwardly to said perimeter surfaces, wherein said sole includes a bridge extending from said sole to said second weighting member.

2. The golf putter of claim 1 wherein the main body frame is comprised of a first material having a first density and the first weighting member and the second weighting member are each comprised of a material different from said first material.

3. The golf putter head of claim 2 wherein said different material has a density greater than the density of the first material.

4. The golf putter head of claim 2 wherein the first weighting member and the second weighting member are comprised of different materials.

5. The golf putter head of claim 2 wherein said first weighting member is comprised of a second material having a second density and said second weighting member is comprised of a third material having a third density.

6. The golf putter head of claim 2 wherein said first material is aluminum.

7. The golf putter head of claim 2 wherein said different material is selected from the group consisting of brass, tungsten, stainless steel, and iron.

8. The golf putter head of claim 1 wherein said bridge is integral with said main body frame.

9. The golf putter head of claim 1 wherein said bridge is separate frame said main body frame.

10. The golf putter head of claim 1 wherein said bridge is fastened to said second weighting member.

11. The golf putter head of claim 1 wherein said second weighting member and said first weighting member are attached to said main body frame and said bridge is attached to said second weighting member.

12. The golf putter head of claim 1 wherein said bridge is angled upwardly from said second weighting member toward said sole.

13. A golf putter head comprising:

a main body frame having a top surface, a pair of side surfaces, a rear surface, a milled out front portion including a front surface, a milled out portion beneath said top surface including an underside disposed in an upper portion of said main body, a sole opposed to the top surface, and a bridge extending outwardly from said sole towards said rear surface;

a first weighting member attached to said front surface; and a second weighting member having a rear portion and opposed side portions extending outwardly to said rear and side surfaces, respectively, said weighting member attached to said underside.

14. The golf putter head of claim 13 wherein the main body frame is comprised of a first material having a first density and the first weighting member and the second weighting member are comprised of a material different from said first material, said different material having a different density.

15. The golf putter head of claim 14 wherein said different density is greater than said first density.

16. The golf putter head of claim 13 wherein any two of the group consisting of a main body frame weight, a first weighting member weight, and a second weighting member weight are the same weight.

17. The golf putter head of claim 13 wherein either said first weighting member and said second weighting member weigh the same or said first weighting member and said main body frame weigh the same.

18. The golf putter head of claim 13 wherein the first weighting member and the second weighting member are the same weight.

19. The golf putter head of claim 13 wherein the first weighting member and the main body frame are the same weight.

20. The golf putter head of claim 13 wherein said milled out portion beneath said top surface is between said sole and said top surface.

21. The golf putter head of claim 13 wherein one end of said bridge is attached to said second weighting member and the other end of said bridge is attached to said sole.

22. A golf putter head comprising:

a main body frame comprised of a first material having a first density, said main body having a top surface, an underside of said top surface, the underside disposed in an upper portion of the main body, a pair of side surfaces, a rear surface, a frontwardly facing surface disposed between the side surfaces, and a sole opposed to said top surface, including a bridge;

a first weighting member supported by said main body frame and disposed adjacent to said front surface of said main body frame; and a second weighting member supported by said main body frame and disposed adjacent to said underside, said second weighting member including a rear portion and opposed side portions and extending outwardly to said rear and pair of side surfaces, wherein said bridge extends out from said sole and is in contact with said second weighting member.

* * * * *